US005966578A

United States Patent [19]

Soutome et al.

[11] Patent Number: 5,966,578

[45] Date of Patent: Oct. 12, 1999

[54] HEAT-PRESSURE FIXING DEVICE AND SILICONE RUBBER ROLLER

[75] Inventors: Osamu Soutome; Kazuo Kishino, both of Kawasaki; Masaaki Takahashi, Asaka; Jiro Ishizuka, Numazu; Hideo Kawamoto, Tokyo; Mitsuhiro Ohta, Susono, all of Japan

[73] Assignee: Canon Kabushiki Kaisha, Tokyo, Japan

[21] Appl. No.: 09/122,745

[22] Filed: Jul. 27, 1998

[30] Foreign Application Priority Data

Jul. 28, 1997 [JP] Japan ..... 9-201808
Jul. 23, 1998 [JP] Japan ..... 10-208032

[51] Int. Cl.[6] ..... G03G 15/20

[52] U.S. Cl. ..... 399/333; 399/320; 399/324; 399/328

[58] Field of Search ..... 399/328, 330, 399/333, 320, 324; 492/18, 53, 56, 46

[56] References Cited

U.S. PATENT DOCUMENTS

| | | | |
|---|---|---|---|
| 4,763,158 | 8/1988 | Schlueter, Jr. | 430/99 |
| 4,970,559 | 11/1990 | Miyabayashi et al. | 355/290 |
| 5,017,969 | 5/1991 | Mitomi et al. | 355/271 |
| 5,049,948 | 9/1991 | Brown et al. | 355/319 |
| 5,285,248 | 2/1994 | Menjo et al. | 355/284 |
| 5,319,427 | 6/1994 | Sakurai et al. | 355/285 |
| 5,354,612 | 10/1994 | Miyabayashi | 430/99 |
| 5,364,697 | 11/1994 | Miyabayashi | 430/99 |
| 5,420,679 | 5/1995 | Goto et al. | 355/285 |
| 5,587,208 | 12/1996 | Badesha et al. | 355/285 |
| 5,600,421 | 2/1997 | Takekoshi et al. | 399/66 |
| 5,608,508 | 3/1997 | Kumagai et al. | 399/339 |
| 5,643,973 | 7/1997 | Miyabayashi | 399/339 |
| 5,717,988 | 2/1998 | Jinzai et al. | 399/333 |
| 5,747,212 | 5/1998 | Kaplan et al. | 430/124 |

FOREIGN PATENT DOCUMENTS

| | | |
|---|---|---|
| 0 713 158 | 5/1996 | European Pat. Off. . |
| 1-276159 | 11/1989 | Japan . |
| 3-069977 | 3/1991 | Japan . |
| 3-231274 | 10/1991 | Japan . |
| 5-214250 | 8/1993 | Japan . |
| 6-258957 | 9/1994 | Japan . |
| 7-302002 | 11/1995 | Japan . |
| 7-311508 | 11/1995 | Japan . |
| 8-339127 | 12/1996 | Japan . |
| 9-106191 | 4/1997 | Japan . |

OTHER PUBLICATIONS

European Search Report.

*Primary Examiner*—Richard Moses
*Assistant Examiner*—Shival Virmani
*Attorney, Agent, or Firm*—Fitzpatrick, Cella, Harper & Scinto

[57] ABSTRACT

A heat-pressure fixing device for fixing a toner image is composed of a fixing member, a pressure member and an oil applicator for applying dimethylsilicone oil as a release oil. The fixing member is surfaced with dimethylsilicone rubber having a storage modulus E' satisfying $1.0\times10^6$ dyn/cm$^2$<E'<$1.5\times10^7$ dyn/cm$^2$ and a loss modulus E" satisfying $1.0\times10^5$ dyn/cm$^2$<E"<$7.5\times10^5$ dyn/cm$^2$, and exhibits a good release performance at a low dimethylsilicone oil application rate of 1–20 mg/A4-size (621 cm$^2$).

17 Claims, 3 Drawing Sheets

HEAT-PRESSURE FIXING DEVICE AND SILICONE RUBBER ROLLER

FIELD OF THE INVENTION AND RELATED ART

The present invention relates to a heat-pressure fixing device for use in electrophotographic image forming apparatus, such as a copying machine and a laser beam printer, and a silicone rubber roller used in such a heat-pressure fixing device.

An electrophotographic image forming apparatus, such as a copying machine or a laser beam printer, is equipped with a fixing device for fixing a toner onto a recording sheet to form a permanent image. The fixing device generally has a pressure application mechanism including a pair of a heating member and a pressure member, such as a pair of rollers, a film and a roller, or a belt and a roller. When a recording sheet carrying an unfixed toner image on its surface is passed between such a pair of heated and pressurized members, the toner image is fixed as a permanent image onto the recording sheet. The recording sheet may generally comprise a sheet of paper or a sheet of OHP (overhead projector) transparency. Such a fixing device for fixing a toner image into a permanent image is generally called a heat-pressure fixing device, a heat fixing device or a toner fixing device, or simply a fixing device.

Among such heat-pressure fixing devices, one including a pair of heating and pressure members both composed of rollers is called a roller heat-pressure fixing device or a roller fixing device. In such a heat-pressure fixing device, a member on a side of contacting an unfixed toner image is called a fixing member, and the other member is called a pressure member.

In the heat-pressure fixing device, the outermost layer of a fixing member or a pressure member is called a surface layer. Such a surface layer directly contacts a toner image on a recording sheet, so that the function and the performance of the surface layer greatly affects the image quality, etc., of the resultant fixed toner images.

Among the functions and the performances required, toner releasability may be enumerated as one of the most important property. The toner releasability refers to a property or degree of the surface layer by which the toner is not readily attached to the surface layer. The transfer or attachment of (a portion of) toner from an unfixed toner image onto such a surface layer of the fixing member is generally called "toner offset" or simply "offset".

For example, in case where the surface layer of a fixing roller has a poor toner releasability, i.e., the toner is liable to be attached to the surface layer, an unfixed toner image is liable to cause toner offset, or the permanent image (fixed image) is liable to be accompanied with a toner dropout and thus inferior image quality. Further, the offset toner is liable to attach onto a subsequent unfixed toner image, thus causing image defects, called toner soiling or offset image. Further, the toner offset is liable to stick to a member abutted onto the fixing roller, when such a member is present, thus causing such difficulties as damaging the surface layer and the function of the member.

Further, if the pressure member has a surface layer showing inferior toner releasability, a problem can arise in the case of image formation on both sides. In the both side image formation, a recording sheet having an image on a first surface after heat-pressure fixation is inverted automatically or manually so as to allow image formation on a second surface, subjected to the image formation on the second surface, and then again subjected to heat-pressure fixation, as an ordinary practice. Accordingly, at the time of the toner image fixation on the second surface, the already fixed permanent image contacts the pressure member, so that the toner of the permanent image is liable to be offset to deteriorate the image quality and cause a difficulty such as winding of the recording sheet about the pressure member.

Particularly, in the case of a full-color image forming apparatus, such as a full-color copying machine or a full-color laser beam printer, compared with a mono-chromatic image forming apparatus, a particularly high toner releasability is required of the surface layers. This is because in a full-color image forming apparatus, two to four layers of multi-color toners are formed, so that the toners used are required to exhibit good meltability and color-mixability and therefore sharp-melting toners having a low-softening point and a low melt-viscosity are used. Such a toner is called a sharp-melting color toner, a sharp-melting toner, or simply a color toner.

In order to alleviate the above-mentioned problems, the fixing member has a surface layer which generally comprises a material having a good toner releasability and excellent wear resistance and heat resistance, such as a fluorine-containing resin, or silicone rubber.

Particularly, in a heat-pressure fixing device for color copying machine wherein a fixing member may be used under such a severe condition as to deteriorate the toner releasability of the surface layer of a fixing member, a silicone rubber having particularly excellent toner releasability has been frequently used to constitute the surface layer.

Also in an electrophotographic image forming apparatus other than a color copying machine, a silicone rubber is preferably used for similar reasons as described above in case where an improvement in toner releasability is thought much of.

Several proposals have been made so as to provide fixing members having surface layers with improved toner releasability, wear resistance and heat resistance.

JP-A 05-214250 has proposed a fixing member having surface layer comprising silicone rubber reinforced with resinous organo polysiloxane, so as to improve the toner releasability and the physical strengths.

JP-A 07-311508 has proposed a fixing member having a surface layer comprising an addition-type dimethylsilicone rubber containing resinous dimethylpolysiloxane and inorganic fine powder, so as to further improve the physical strength and toner releasability in combination.

However, in a color copying machine using a fixing member having a surface layer composed of such a material, the heat-pressure fixing device indispensably requires means for uniformly applying a release oil onto the surface layer in order to ensure the toner releasability. In the case of using a surface layer comprising dimethylsilicone rubber as described above, a dimethylsilicone oil having a viscosity of 100–1000 CSt at 25° C. is generally used as a release oil. Further, in the case of a heat-pressure fixing device including a fixing member having a surface layer comprising dimethylsilicone rubber as described above, the release oil has to be applied at a rate of at least 40 mg/621 $cm^2$ (A4-size sheet) in order to ensure the toner releasability.

On the other hand, the application of a release oil is liable to result in a sticky copy sheet, particularly in the case of producing an OHP film copy sheet. In the case of a heat-pressure fixing device requiring a release oil applied at a rate of 40 mg/sheet or more, the production of oil-sticky OHP film sheets has been remarkably noted to a level of practical problem in some cases. In order to reduce the stickiness, the application amount of the release oil has to be reduced, and it is required to provide a fixing member having a surface layer of which the toner releasability is ensured at a smaller amount of release oil.

SUMMARY OF THE INVENTION

An object of the present invention is to provide a heat-pressure fixing device capable of ensuring a good toner releasability even at an application amount of a release oil small enough to alleviate the problem of oil stickiness on the OHP film sheet.

Another object of the present invention is to provide a heat-pressure fixing device including a fixing member having a toner releasability and physical strengths which can be retained in a good balance for a long period.

Another object of the present invention is to provide a silicone rubber roller having a toner releasability and physical strengths which are excellent and stable for a long period.

According to the present invention, there is provided a heat-pressure fixing device for fixing a toner image, comprising a fixing member, a pressure member, and means for applying dimethylsilicone oil as a release oil, wherein the fixing member is surfaced with dimethylsilicone rubber having a storage modulus E' satisfying $1.0\times10^6$ dyn/cm$^2$<E'<$1.5\times10^7$ dyn/cm$^2$ and a loss modulus E" satisfying $1.0\times10^5$ dyn/cm$^2$<E"<$7.5\times10^5$ dyn/cm$^2$, and the dimethylsilicone oil is applied onto the surface of the fixing member at a rate of 1–20 mg/621-cm$^2$ (A4-size).

According to another aspect of the present invention, there is provided a silicone rubber roller, surfaced with dimethylsilicone rubber having a storage modulus E' satisfying $1.0\times10^6$ dyn/cm$^2$<E'<$1.5\times10^7$ dyn/cm$^2$ and a loss modulus E" satisfying $1.0\times10^5$ dyn/cm$^2$<E"<$7.5\times10^5$ dyn/cm$^2$.

The heat-pressure fixing device according to the present invention can exhibit a good toner releasability for a long period at a small application amount of dimethylsilicone oil, and has been provided through a course of our study as will be described below.

We have noted a relationship between a toner releasability and a dynamic viscoelasticity of a surface layer comprising dimethylsilicone rubber. The toner releasability may be considered in terms of two factors, i.e., an initial releasability that is a toner releasability of a silicone rubber not yet used, and a releasability-lowering speed showing a speed of lowering in releasability of the surface layer per use thereof. The dynamic viscoelasticity of a surface layer may be separated into a storage modulus E' regarding an elasticity term and a loss modulus E" regarding a viscosity term. The storage modulus and loss modulus discussed herein are based on values measured according to a method described hereinafter (in Examples). As a result of analysis of correlation among these four factors, there have been found tendencies that a smaller storage modulus results in a smaller releasability lowering speed, and a smaller loss modulus results in a larger initial releasability. Now, if a release life is defined as a time until the occurrence of offset image, the release life may be extended by increasing the initial releasability and reducing the releasability lowering speed. This may be synergistically accomplished by reducing both the storage modulus and the loss modulus, thus providing dimethylsilicone rubber having excellent toner releasability.

Based on the above-mentioned knowledge about toner releasability, in the case of applying dimethylsilicone oil as release oil at a rate of 1 mg–20 mg/A4, it has been found possible to provide a surface layer of dimethylsilicone rubber exhibiting a long release life and excellent toner releasability by lowering the storage modulus of the dimethylsilicone rubber to below $1.5\times10^7$ dyn/cm$^2$, and lowering the loss modulus to below $7.5\times10^5$ dyn/cm$^2$.

On the other hand, in order to satisfy physical strengths, the storage modulus and the loss modulus are required to exceed certain lower limits. More specifically, in this respect, it has been found necessary to form a surface layer of dimethylsilicone rubber having a storage modulus larger than $1\times10^6$ dyn/cm and a loss modulus larger than $1.0\times10^5$ dyn/cm$^2$.

Based on the above knowledge, it has been found possible to provide a heat-pressure fixing device comprising a fixing member and means for applying a release oil onto the fixing member, wherein the release oil comprises dimethylsilicone oil and is applied at rate of 1–20 mg/A4-size (=621 cm$^2$), and the fixing member has a surface layer comprising dimethylsilicone rubber having a storage modulus E' at 170° C. satisfying $1\times10^6$ dyn/cm$^2$<E'<$1.5\times10^7$ dyn/cm$^2$ and a loss modulus E" at 170° C. satisfying $1\times10^5$ dyn/cm<E"<$7.5\times10^5$ dyn/cm$^2$, whereby the fixing member can exhibit excellent toner releasability even at a small release oil application amount so as to be substantially free from oil stickiness on an OHP transparency film.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
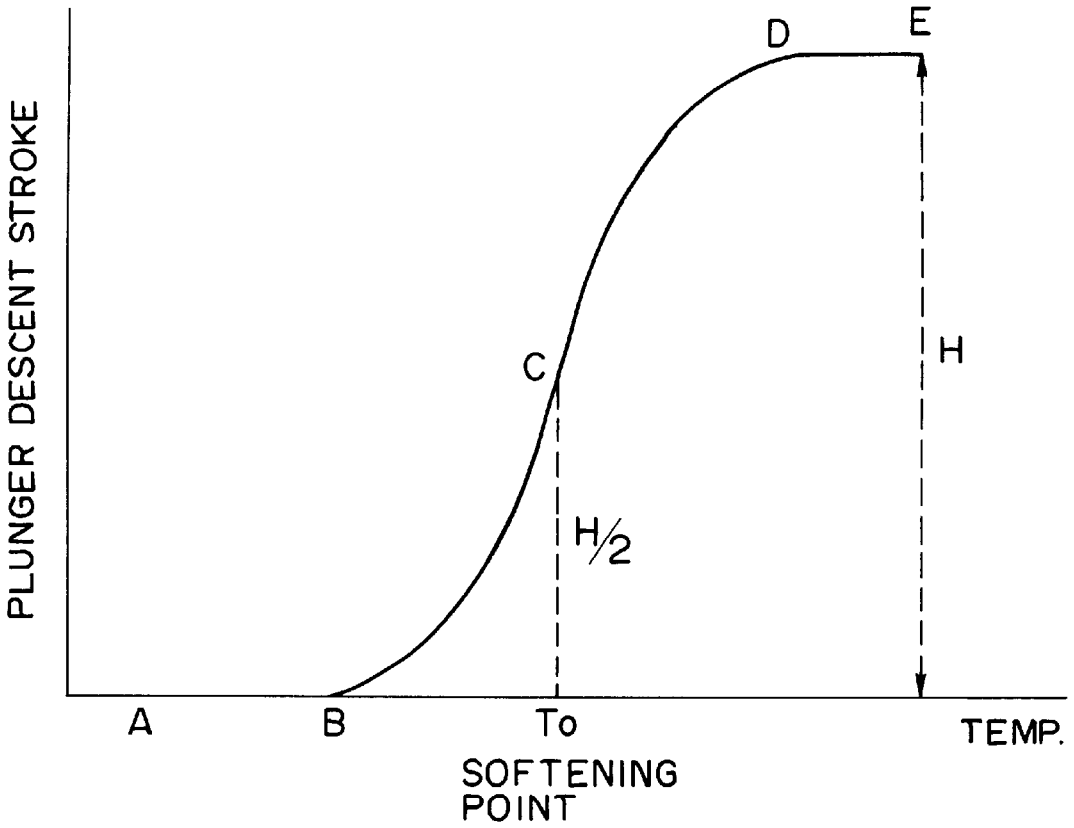
FIG. 1 is a graph showing a softening characteristic curve of a sharp-melting toner.

Dimethylsilicone rubber constituting at least a surface layer of a fixing member in the fixing device according to the present invention may preferably comprise an addition-polymerization product of addition-type liquid silicone rubber comprising:

(A) a polysiloxane mixture comprising (a) 50–70 wt. % of an organopolysiloxane comprising a network polysiloxane segment and having at least two vinyl groups per molecule, and (b) 30–50 wt. % of a linear polydimethylsiloxane having a terminal vinyl group at both terminals and having a viscosity at 25° C. of at least 10,000 Pa.s, (B) an organopolysiloxane having at least 2 hydrogen atoms bonded to silicon atoms per molecule, (C) a platinum-based catalyst, and (D) a ferric chloride providing 3–300 wt. ppm of iron based on the total amount of (A)+(B)+(C). The network structure of the network polysiloxane segment may be two-dimensional or three dimensional and may comprise an appropriate combination of three-functional and four-functional siloxane units.

The organopolysiloxane (A)(a) is effective for enhancing the physical strength, and the linear polydimethyl siloxane (A)(b) is effective for enhancing the toner releasability. In the polysiloxane mixture (A), the linear polydimethylsiloxane may preferably constitute at least 30 wt. % so as to effectively enhance the toner releasability and at most 50 wt. % so as not to lower the physical strength. The linear polydimethylsiloxane may preferably have a viscosity at 25° C. of at least 10,000 Pa.s so as to provide a good toner releasability.

The organopolysiloxane (B) is a crosslinking agent for hardening the mixture component (A) and may be used in an amount sufficient to cause a desired level of hardening.

More specifically, the organopolysiloxane (B) may preferably be used in an amount providing 0.6–20 silicon-bonded hydrogen atoms for one mol of vinyl groups totally contained in the polysiloxane mixture (A). Below 0.6 atom, the curing of the silicone rubber is liable to be insufficient and, above 20 atoms, the cured silicone rubber is liable to have an insufficient heat-resistance or lower physical strengths due to evolution of a large amount of hydrogen at the time of curing.

The platinum-based catalyst (C) is a catalyst for causing addition and curing between the components (A) and (B).

The platinum-based catalyst (C) may preferably be used in an amount of 0.1–500 wt. parts per $10^6$ wt. parts (i.e., 0.1–500 wt. ppm) of the total of the polysiloxanes (A) and (B). The platinum-based catalyst (C) may assume an arbitrary form and may for example comprise platinum chloride acid or an alcohol solution thereof, platinum chloride acid-olefin complex, platinum chloride acid-vinylsiloxane complex, platinum carried on silica, or platinum carried on activated carbon.

The ferric chloride (D) is a component effective for providing a dimethylsilicone rubber exhibiting little change in physical strength and little change in viscoelasticity after the hardening thereof, and may be used in an amount of at least 3 ppm so as to appropriately exhibit its effect, and an amount exceeding about 300 ppm is unnecessary.

In order to further enhance the toner releasability, the organopolysiloxane (A)(a) may comprise a block copolymer including at least one network polysiloxane segment having a vinyl group and a linear segment comprising at least 100 consecutive difunctional siloxane units, preferably dimethyl siloxane units, may have a viscosity at 25° C. of at least 1 Pa.s.

In the block copolymer constituting the organosiloxane (A)(a), it is preferred that the linear polysiloxane segment is free from a vinyl group. The block copolymer may preferably comprise a generally linear structure having a network polysiloxane segment having a vinyl group at both ends, and particularly preferably comprise a form of block copolymer having a linear polysiloxane segment comprising at least 100 difunctional siloxane segments, preferably dimethylsilicone segments, sandwiched between a pair of network polysiloxane segments each having a vinyl group.

In order to enhance the toner releasability, it is also effective to further and 5–20 wt. parts of dimethylsilicone oil to 100 wt. parts in total of the above-mentioned components (A), (B), (C) and (D). By the addition of dimethylsilicone oil, it is possible to lower the storage modulus in a controlled manner without remarkably changing the loss modulus of the resultant silicone rubber. As a result, it becomes possible to easily provide a silicone rubber having desired viscoelasticity.

The fixing of toner image may generally be accomplished by energizing a halogen lamp or a heat-generating resistance member to cause heat generation and heating the toner image via a roller or a film as the fixing member. Alternatively, it is also possible to cause an eddy current in an electroconductive layer formed on a film by electromagnetic induction and use the heat evolved thereby to heat the toner image for fixation.

The pressure member for pressing a toner image against the fixing member may comprise a roller or a belt which rotates or moves while sandwiching a recording sheet carrying the toner image under pressure in cooperation with the fixing member. The pressure member may generally comprise an elastic pressure roller.

In another embodiment of the heat-pressure fixing device according to the present invention, an endless film as a fixing member may be used in order to shorten the warming-up time prior to the fixing operation. More specifically, such an embodiment of the heat-pressure fixing device according to the present invention may comprise a heating member, a heat-resistant fixing film which moves relative to the heating member with its one surface rubbing the heating member and moves together with a recording sheet with the other surface contacting the recording sheet, conveying means (such as drive rollers) around which the fixing film is wound, and a pressure member forming a nip with the heating member via the fixing film, whereby an unfixed toner image carried on the recording sheet conveyed together with the fixing film is heated by heat evolved from the heating member via the fixing film at the nip, thereby fixing the toner image onto the recording sheet.

The heat-resistant endless fixing film may suitably comprise a heat-resistant resinous film substrate, such as a 20 to 80 μm-thick polyimide film, coated via a primer layer with a 100 to 300 μm-thick dimethylsilicone rubber layer.

In the case of forming toner images on both sides (i.e., surfaces) of a recording sheet, it is preferred that the pressure member is also surfaced with a dimethylsilicone rubber identical to the one surfacing the fixing member as described above.

The surfacing of the fixing member or the pressure member may be realized by surface coating of a substrate for constituting the fixing or pressure member with a surface layer of the dimethyl silicone rubber specified above, or the fixing member or the pressure may be composed of the dimethylsilicone rubber specified above.

The silicone rubber layer constituting the surface layer of the fixing member or pressure member may have a thickness in the range of 1 μm–2 mm. Particularly, in the case where the surface layer of the fixing member or pressure member has a laminate elastomeric layer structure, the silicone rubber surface layer disposed on a lower elastomeric layer may preferably have a thickness of 1–300 μm, particularly 50–300 μm, so as to realize good fixation of high-quality toner images, regardless of whether the fixing or pressure member is of the roller type or the belt (or film) type.

The fixing device according to the present invention may particularly effectively be applicable to fixation of toner images comprising three or more color toners. A color toner is required to exhibit a sharp-meltability so as to easily cause melt-color mixing of two or more color toner images disposed in superposition on a recording sheet. By using such a sharp-melting color toner, it becomes possible to provide a permanent image with enhanced color reproducibility, which is faithful to multi-color or full-color image of the original. However, in the use of such a sharp-melting toner, the lowering in molecular cohesion of toner component polymer at the time of heat melting is liable to increase the force of attachment onto the surface layer, thus resulting in so-called high-temperature offset caused due to excessive melting. However, as the fixing device of the present invention can exhibit excellent anti-offset performance by application of a small amount of offset-preventing silicone oil, so that the fixing device of the present invention may be suitably used in multi-color image formation using a sharp-melting toner.

A sharp-melting color toner may for example be prepared by subjecting toner constituent material including a binder resin, such as a polyester resin or a styrene-acrylate resin, a colorant (dye, pigment, sublimable dye, etc.) and a charge control agent, to melt-kneading, pulverization and classification. The thus formed toner particles may be subjected as desired to an external blending step of blending therewith various external additives, such as hydrophobic colloidal silica. Such a color toner may particularly suitably be one comprising a polyester resin as a binder resin, in view of fixability and sharp-meltability. A sharp-melting polyester resin may be provided as a polymer having ester bonds in its main chain formed by reaction of a diol compound and a dicarboxylic acid. A particularly preferred class of polyester compounds may include those obtainable by polycondensation between a bisphenol deviative represented by the following formula:

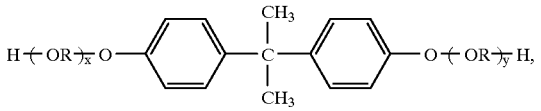

wherein R denotes an ethylene or propylene group, x and y respectively denote a positive number of at least 1 providing an average of x+y of 2–10, or a substitution derivative thereof, as a diol component, and a carboxylic acid component, such as a di-functional or more-functional carboxylic acid, an anhydride thereof or a lower alkyl ester thereof, e.g., fumaric acid, maleic acid, maleic anhydride, phthalic acid, terephthalic acid, trimellitic acid or pyrromellitic acid, in view of sharp-melting characteristics.

The polyester resin may preferably have a softening point (as measured according to a method described below) of 75–150° C., more preferably 80–120° C.

FIG. 1 illustrates a softening (or melt flow) characteristic curve of a sharp-melting toner containing such a polyester resin as a binder resin obtained in the following manner.

A flow tester ("CFT-500A", available from Shimadzu Seisakusho K. K.) equipped with a die (nozzle) having a diameter of 0.2 mm and a length of 1.0 mm is used for measurement. A fine powdery toner sample accurately weighed at 1–3 g is placed in a vertical cylinder leading to the nozzle and pressed under a plunger having a sectional area of 1.0 $cm^2$. The sample toner is preheated at an initial set temperature of 70° C. for 300 sec. and then heated at a constant temperature-raising rate of 6° C./min. under application of an extrusion load of 20 kg via the plunger. Under this condition, the plunger descent amounts (or strokes) are measured versus temperatures to obtain a softening characteristic curve as shown in FIG. 1. Referring to FIG. 1, under a constant rate of temperature-raising, the plunger first descends to some extent due to packing of the powder sample into a solid mass in the cylinder (not shown), and then assumes a substantially no moving state (A–B). On further heating, the toner sample begins to flow through the nozzle (at B) and flows at an increasing rate (B–C–D) to finish its flow as identified by the stopping of the plunger (D–E) to provide an S character-like softening characteristic curve.

A height H on the S character-like curve represents a total stroke of the plunger descent indicating the total amount of flowed sample. A point C corresponding to a height H/2 on the curve gives a softening point $T_0$ of the sample toner (or a binder resin when such a resin is used as a sample).

Whether a toner or a binder resin has a sharp-melting characteristic or not can be evaluated by an apparent melt viscosity of the toner or binder resin.

Herein, a sharp-melting toner or binder resin is defined as one satisfying the conditions of T1=90–150° C. and $|\Delta T|=|T1-T2|=5-20°$ C., wherein T1 and T2 denote temperatures at which the sample shows apparent melt viscosities of $10^3$ poise and $5\times10^2$ poise, respectively.

A sharp-melting toner (or resin) having such a temperature-melt viscosity characteristic causes an extremely sharp lowering in viscosity. Such a viscosity lowering promotes an appropriate degree of mixing of superposed toner layers including an uppermost toner layer and a lowermost toner layer, and remarkably increases the transparency of the toner layer per se, thereby causing a satisfactory subtractive color mixing and thus providing an improved color reproducibility in the resultant fixed toner image (permanent image).

An image forming apparatus including such a heat-pressure fixing device according to the present invention will now be described more specifically.

Figure 2:
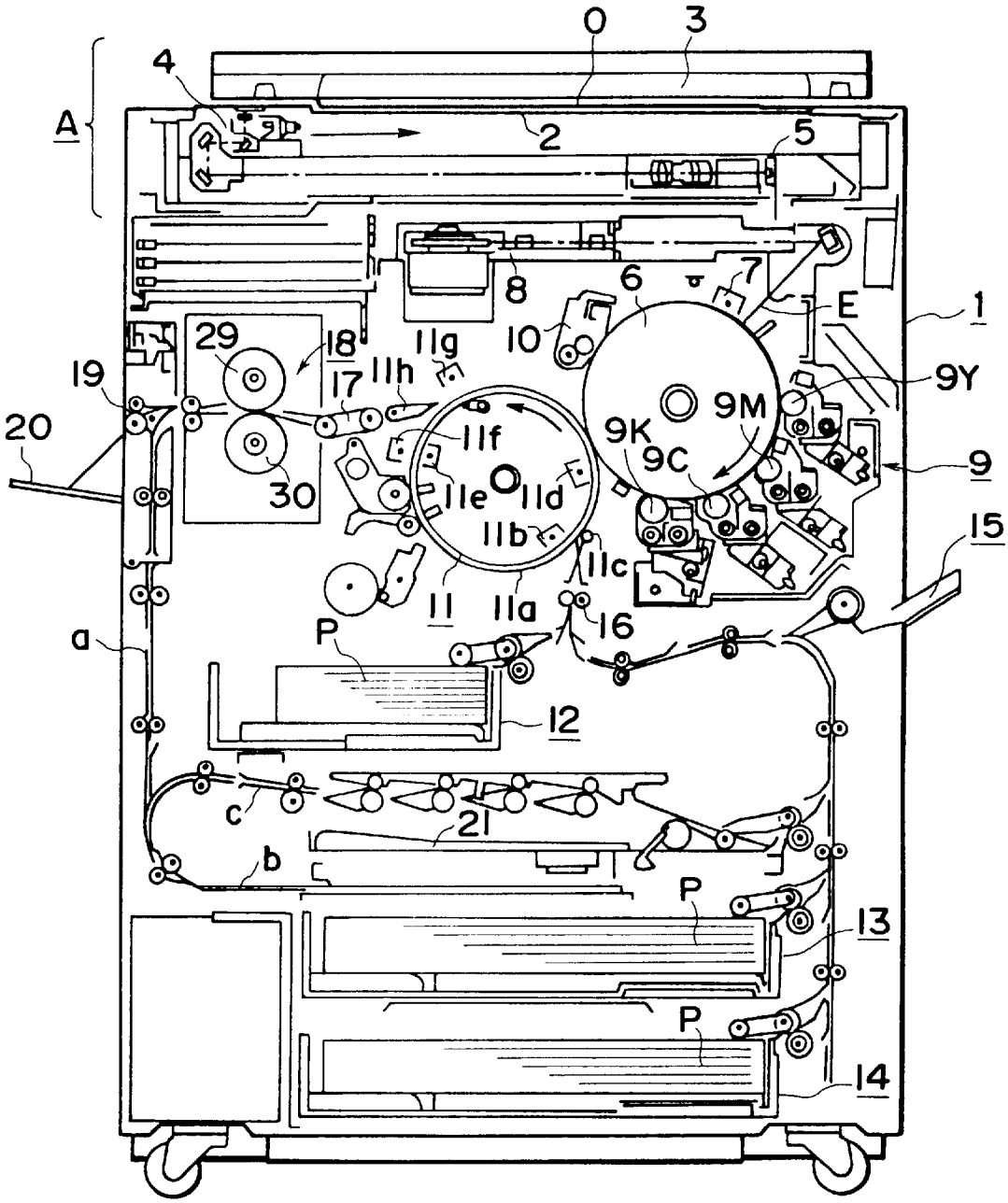
FIG. 2 is a schematic illustration of an image forming apparatus including a heat-pressure fixing device.

FIG. 2 is a schematic illustration of an embodiment of the image forming apparatus according to the present invention. The apparatus according to this embodiment is an electrophotographic color image forming apparatus having a both side-image forming function wherein a recording sheet having an already fixed image on its first surface is conveyed again to an image forming section and a fixing means to effect image formation and fixation on its second surface, thereby providing permanent images on both surfaces of the recording sheet. The apparatus can be used for forming an image on only one surface without forming images on both surfaces.

Referring to FIG. 2, the apparatus includes an outer housing 1 of apparatus main body, and an original scanning reader unit A disposed on the outer housing. In an operation of the reader unit A, an original O is set with its image surface directed downwards at a prescribed place on an original surface glass 2, and is covered with an original pressing plate 3. Then, a reading operation is started, whereby a moving optical system 4 disposed below the original support glass 2 is moved from one side to the other side along the lower surface of the original support glass 2 to illuminate and scan the downwardly directed image surface of the set original on the original support glass 3, and reflected light from the original surface is focused at a photoelectric reading unit 5 and color-separated by a color separation filter, whereby respective separated color component images of the original image are photoelectrically read as color image signals (time-serial electric digital pixel signals) and stored in a memory circuit.

Inside the housing 1, the apparatus includes an electrophotographic photosensitive drum 6 of e.g., 180 mm in diameter, as an image-bearing member in an image forming section. The drum 6 is driven in rotation in a clockwise direction indicated by an arrow at a prescribed process speed (peripheral speed). Around the photosensitive drum 6, there are disposed a charger 7 for uniformly charging the photosensitive drum to a prescribed polarity and a prescribed potential, an imagewise exposure means 8 including a laser and a polygonal lens-mirror system, etc., whereby the charged surface of the photosensitive drum surface 6 is scanningly exposed to laser beam E outputted from the imagewise exposure means 8 after modulation based on the time-serial electric digital image signals from the memory circuit, thus forming an electrostatic latent image on the rotating photosensitive drum 6 surface corresponding to the scanning exposure pattern.

The apparatus further includes a combined developing apparatus 9 including a cyan developing device 9C containing a cyan toner, a magenta developing device 9M containing a magenta toner, a yellow developing device 9Y containing a yellow toner and a black developing device 9K containing a black toner, and the four developing devices 9C, 9M, 9Y and 9K are selectively caused to act on the rotating photosensitive drum 6 to develop the electrostatic latent image thereon.

A transfer drum 11 contacts the photosensitive drum 6 subsequent to the combined developing apparatus 9 and is driven in rotation in an identical direction and at a substantially identical peripheral speed with the photosensitive drum 6. The transfer drum may have a diameter of, e.g., 180 mm and may be coated with a recording material carrier sheet 11*a* of a dielectric film as a recording material carrying means wound about under tension integrally about the outer peripheral surface thereof. Further, around the transfer drum 11, there are disposed a corona charger 11*b* as an attracting charger means for attaching a recording material onto the outer surface of the transfer drum 6, an abutting roller 11*b* functioning as a counter roller thereof, a transfer corona charger 11*d* for transferring a toner image carried on the photosensitive drum 6 onto a recording material attached onto the transfer drum 11, an inner corona charger 11*e*, an outer corona charger 11*f*, a recording material separating charger 11*g*, and a recording material separating claw 11*h*.

The image forming apparatus further includes first to third recording material feed mechanisms 12, 13 and 14, and a hand-inserting recording material feeder unit 15. A recording material (or recording sheet or transfer material) P is supplied sheet by sheet from a selected one of the first to third recording material feed mechanisms 12–14 or the hand-inserting feeder unit 15 and sent through a prescribed sheet path including a guide plate and conveyer rollers to a pair of register rollers 16.

Then, by the register rollers 16, the recording material is supplied to the transfer drum 11 at a prescribed time and wound and electrostatically held about the outer peripheral surface of the transfer drum 11 to be conveyed integrally with the transfer drum 11. Onto the outer surface of the recording material, a toner image carried on the photosensitive drum 6 is transferred by the action of the transfer corona charger 11*d*. The surface of the rotating photosensitive drum 6 after the transfer of the toner image on the recording material P is subjected to removal of residual attachment, such as transfer residual toner, by a cleaner (cleaning device) 10.

In the case of a full-color image formation mode, the operation of the photosensitive drum 4 and the transfer drum 11 are subjected to four image formation-transfer cycles (i)–(iv), including:

(i) charging→imagewise exposure to laser beam E modified by a cyan image signal among the color separation image signals of the objective color image →development by the cyan developing device 9C→transfer of the resultant cyan toner image onto the recording material carried on the transfer drum 11 cleaning, respectively, for the photosensitive drum 6;

(ii) charging→imagewise exposure to laser beam E modified by a magenta image signal among the color separation image signals of the objective color image →development by the magenta developing device 9M→transfer of the resultant magenta toner image onto the recording material carried on the transfer drum 11→cleaning, respectively, for the photosensitive drum 6;

(iii) charging→imagewise exposure to laser beam E modified by a yellow image signal among the color separation image signals of the objective color image→development by the yellow developing device 9Y→transfer of the resultant yellow toner image onto the recording material carried on the transfer drum 11→cleaning, respectively, for the photosensitive drum 6; and (iv) charging→imagewise exposure to laser beam E modified by a black image signal among the color separation image signals of the objective color image →development by the black developing device 9K→transfer of the resultant black toner image onto the recording material carried on the transfer drum 11→cleaning, respectively, for the photosensitive drum 6. As a result, totally four color toner images including the above-mentioned cyan toner image, magenta toner image, yellow toner image and black toner image are superposed in registration with each other on the outer surface (first surface) of a single recording material P wound about and held on the rotating transfer drum 11.

After the superpositive transfer of the four color toner images on the single recording material P held on the transfer drum 11, the recording material P is charge-removed by the separation charger 11*g*, separated from the transfer drum 11 by the separation claw 11*h* as separation means and sent by a conveyer means 17 to a fixing device (a hot roller fixing device in this embodiment) 18, where the four color toner images are simultaneously fixed onto the recording material surface.

In the case of one-side image formation mode, the recording material having a fixed toner image on its one surface (first surface) is discharged to a discharged paper tray 20 outside the main body of the image forming machine.

In the case of two-side image formation mode, a recording material having a fixed image on its one surface is introduced to a re-conveying sheet path a, inverted upside down while being passed through a switch-back sheet path b and a sheet path c to be sent to an intermediate tray 21. From the intermediate tray 21, the recording material is again conveyed via the register rollers 16 and then to the transfer drum 11, where the recording material is wound abut the transfer drum 11 with its first surface directed inward and its second surface exposed to outside.

On the second surface of the recording material, from color-separated toner images for the second surface are sequentially formed and transferred similarly as on the first surface to be superposed thereon. Then, the recording material is separated from the transfer drum 11 and sent again to the fixing device 18, where the four color toner images on the second surface are simultaneously fixed to provide a recording material having fixed full-color images on both surfaces, which is then discharged to the discharged paper tray 20 via the discharge port 19.

It is also possible that a recording material having a fixed image on its first surface is once discharged to the discharged paper tray, and the recording material is manually inverted upside down so as to have its second surface directed upward and inserted through the hand-inserting feeder unit 15 to the apparatus for image formation on the second surface.

Incidentally, the order of four color-separated toner image formation is basically arbitrary and need not be restricted to the one adopted in the above-described embodiment. Further, in the case of forming a white-black monochromatic copy, only the black developing device 9K is operated. It is also possible to form monochromatic images on both sides or a copy having a full-color image on one surface and a monochromatic image on the other surface by arbitrary selection.

<Organization of a Heat-Pressure Fixing Device>

The heat-pressure fixing device according to the present invention will now be described more specifically based on an embodiment.

Figure 3:
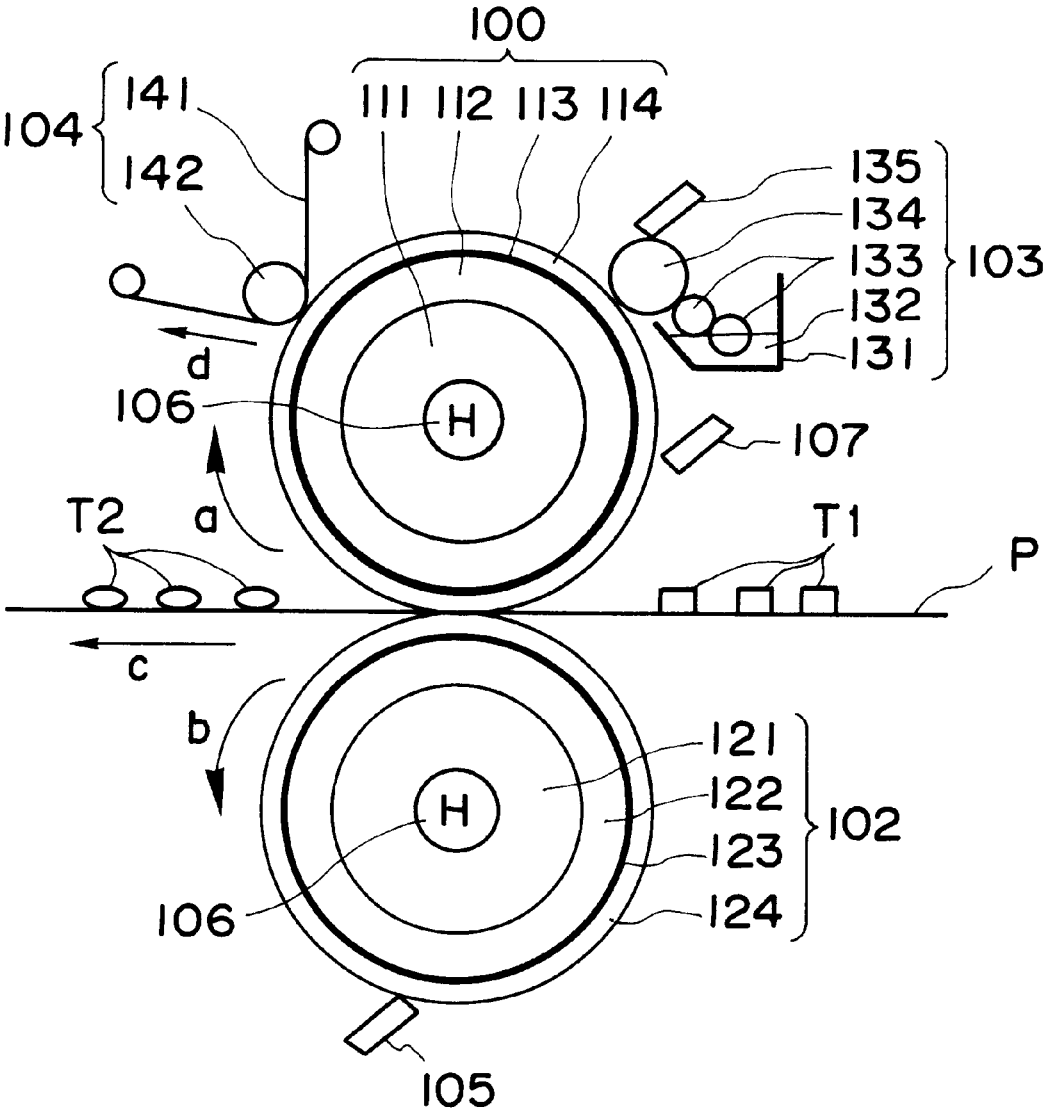
FIG. 3 is a schematic sectional view of a heat-pressure fixing device according to an embodiment of the invention.

FIG. 3 is a schematic sectional view of an embodiment of the heat-pressure fixing device according to the invention and actually used in Examples described hereinafter, including a fixing roller 100 and a pressure roller 101, which are disposed in pair and pressed against each other to form a nip width of ca. 7 mm.

The fixing roller 101 includes a core metal 111 comprising a substrate of aluminum, etc., and an elastic layer 112 formed thereon comprising high-temperature vulcanization-type (HTV or millable-type) silicone rubber. The elastic layer 112 is further coated with a ca. 50 μm-thick oil barrier layer 113 of fluorine-containing rubber and further with a ca. 200 μm-thick surface layer 114 comprising dimethylsilicone rubber. The fixing roller 101 thus formed may have an outer diameter of ca. 60 mm.

The pressure roller 102 may also comprise a core metal 121 comprising a substrate of aluminum, which is successively coated with a ca. 2 mm-thick elastic layer celastic layer comprising HTV (millable)-type silicone rubber, a ca. 50 μm-thick oil barrier layer 123 comprising fluorine-containing rubber and then a ca. 200 μm-thick silicone rubber 124 comprising, e.g., dimethylsilicone rubber. The pressure roller 102 may also have an outer diameter of ca. 60 mm.

Around the fixing roller 101, there are provided an oil application unit 103 for uniformly applying a release oil, a cleaning web unit 104 for removing dirt, such as toner, attached on the surface of the fixing roller 101, and an elastic oil regulating blade 107 for regulating the amount of the release oil on the fixing roller 101.

The oil application unit 103 includes an oil pan 131 for containing the release oil 132, a metallic oil scooping roller 133 for scooping the release oil 132 by rotation, an elastic oil application roller 134 for applying the scooped release oil onto the fixing roller 100 surface by rotation, and an elastic oil regulating blade 135 for regulating the amount of the release oil on the oil application roller 134.

In a specific example, the release oil 132 used was dimethylsilicone oil (trade name "KF-96SS", available from Shin-Etsu Kagaku Kogyo K. K.) having a kinematic viscosity at 25° C. of 300 cSt (centi-stokes).

The cleaning web unit 104 includes a cleaning web 141 of unwoven cloth for removing dirt, such as toner, attached onto the fixing roller 100 surface, and a web-pressing elastic roller 142 for pressing the cleaning web 141 against the fixing roller surface. The cleaning web 141 is pulled little by little in a direction d and around about a roller 142.

The oil-regulating elastic blade 107 is pressed against the fixing roller 100 at a degree arbitrarily controlled by a supporting spring (not shown), thereby controlling the application amount of the release oil onto the fixing roller surface layer 114.

The pressure roller 102 is also equipped with an oil-removing elastic blade 105 for removing excessively applied release oil disposed in contact therewith.

At a center of each of the core metals 111 and 121 of the fixing roller 101 and the pressure roller 102, a heater 106 is disposed so as to provide a prescribed surface temperature as measured by a thermocouple (not shown) disposed in contact with the surface layers 114 and 124 by controlling the energization time of the heater 106. In a specific example, the surface temperature was set to 170° C.

In the heat-pressure fixing device shown in FIG. 3, the fixing roller 101 and the pressure roller 102 rotate in directions a and b, respectively, a recording material (paper) P is conveyed in a direction c, whereby an unfixed toner image T1 is converted into a fixed toner image T2 by passing through a nip between the fixing roller 101 and the pressure roller 102.

<Production of a Fixing Member>

A fixing roller 10 as shown in FIG. 3 as a fixing member was prepared in the following manner. First of all, a heat-resistant grade HTV silicone rubber was vulcanized and applied onto a core metal 111 and then abraded down to an objective diameter. Then, a fluorine-containing rubber paint was applied by spraying thereonto, followed by drying at 150° C. for 30 min. to form a ca. 50 μm-thick fluorine-containing rubber layer. Then, the fluorine-containing rubber layer was coated with a siloxane primer and then with a toluene-diluted uncured silicone rubber liquid (of which a composition will be described in each of Examples described hereinafter), followed by heat-vulcanization for curing to form a ca. 200 μm-thick surface layer comprising dimethylsilicone rubber.

A pressure roller 102 was prepared in a similar manner as the fixing roller 101.

<Measurement of Applied Oil Amount>

The amount of a release oil applied on a surface layer 114 of a fixing roller 101 was measured in the following manner. From the heat-pressure fixing device shown in FIG. 3, the pressure roller 102 and the cleaning web unit 104 were removed, and the fixing roller 101 was heated up to a surface temperature of 170° C. by energization of the heater 106. Then, the fixing roller 101 was rotated by a half turn, whereby a half peripheral surface of the fixing roller was coated with a release oil. Then, an accurately weighed metering filter paper in a rectangular size of 5 cm×30 cm was quickly pressed against the coated are at a pressure of ca. 50 g/cm$^2$ for 1 min. and then peeled. By repeating the above operation, such filter samples were prepared in ten pieces and accurately weighed by a precision balance (1/1000 g) to provide a sample weight, from which the previously measured blank filter paper weight was subtracted to give an absorbed oil amount per unit area of the filter paper that was regarded as the applied oil amount on a unit area of the fixing roller surface.

<Measurement of Dynamic Viscoelasticity of Surface Layer>

Dynamic viscoelasticities of surface layers 114 and 124 of a fixing roller 101 and a pressure roller 102 were measured in the following manner. An uncured addition-type liquid silicone rubber identical to the one used for providing an objective surface layer was cast into a 2 mm-thick sheet, which was heat-vulcanized to be cured to provide a 2 mm-thick sample. The sample was then cut into a size of 5 mm×40 mm and subjected to measurement of dynamic viscoelasticities by a viscoelasticity meter ("DVE RHEOSPECTOLER DVE-V4", available from K. K. Rheology) under the conditions of tensile elongation of 175%, a temperature of 170° C. and a sine wave strain (frequency=100 Hz).

<Specific Surface Layer Materials>

Evaluation was made wit respect to specific surface layer materials prepared in the following material examples.

[Material Examples]

The following surface layer materials were prepared and used in Performance evaluation experiments described hereinafter.

<Material Example 1>

60 wt. parts of organopolysiloxane (A-a-1) in the form of a block copolymer having a viscosity at 25° C. of ca. 30 Pa.s and comprising a linear polysiloxane segment comprising ca. 300 consecutive difunctional dimethylsiloxane units sandwiched between a pair of network polysiloxane segments each having a vinyl group, and 40 wt. parts of linear dimethylpolysiloxane (A-b-1) having a vinyl group at both ends and having a viscosity at 25° C. of ca. 10000 Pa.s were mixed with each other. The mixture was further mixed with organopolysiloxane having at least two silicon-bonded hydrogen atoms per molecule as a crosslinking agent in an amount providing 1.3 silicon-bonded hydrogen atoms per mol of vinyl groups contained in the mixture of the polysiloxanes (A-a-1) and (A-b-1), a platinum-based catalyst, and ferric chloride (D-1) in an amount of 50 wt. ppm of iron in the resultant mixture of the above components, to provide a yet-uncured liquid silicone rubber (S-1).

The silicone rubber (S-1) was one capable of curing through layer-forming steps including application of toluene-diluted silicone rubber, ca. 30 min. of standing for evaporation of the toluene, primary heat-curing at 130° C. for 1 hour and secondary heat-curing at 200° C. for 4 hours, to provide a dimethylsilicone rubber exhibiting a storage modulus of $1.37\times10^7$ dyn/cm$^2$ and a loss modulus of $5.28\times10^5$ dyn/cm$^2$.

<Material Example 2>

To 100 wt. parts of the yet-uncured liquid silicone rubber (S-1) prepared in Material Example 3, 20 wt. parts of dimethylsilicone oil having a weight-average molecular weight of $1.6\times10^5$ was added, to provide yet-uncured liquid silicone rubber (S-2).

The silicone rubber (S-2) was one providing, after curing, a dimethylsilicone rubber exhibiting a storage modulus of $0.89\times10^7$ dyn/cm$^2$ and a loss modulus of $7.0\times10^5$ dyn/cm$^2$.

<Material Example 3>

Yet-uncured liquid silicone rubber (S-3) was prepared in the same manner as in Material Example 1 except for replacing the polysiloxane (A-a-1) and (A-b-1) with 55 wt. parts of organopolysiloxane (A-a-2) in the form of a block copolymer having a viscosity at 25° C. of ca. 20 Pa.s and comprising a linear polysiloxane segment comprising ca. 200 consecutive difunctional dimethylsiloxane units sandwiched between a pair of network polysiloxane segments each having a vinyl group, and 45 wt. parts of linear dimethylpolysiloxane (A-b-2) having a vinyl group at both ends and having a viscosity at 25° C. of ca. 11000 Pa.s.

The silicone rubber (S-3) was one providing, after curing, a dimethylsilicone rubber exhibiting a storage modulus of $0.9\times10^7$ dyn/cm$^2$ and a loss modulus of $3.0\times10^5$ dyn/cm$^2$.

<Material Example 4>

To 100 wt. parts of the yet-uncured liquid silicone rubber (S-3) prepared in Material Example 1, 20 wt. parts of dimethylsilicone oil having a weight-average molecular weight of $1.6\times10^5$ was added, to provide yet-uncured liquid silicone rubber (S-4).

The silicone rubber (S-4) was one providing, after curing, a dimethylsilicone rubber exhibiting a storage modulus of $0.4\times10^7$ dyn/cm$^2$ and a loss modulus of $4.6\times10^5$ dyn/cm$^2$.

<Comparative Material 1>

A yet-uncured liquid silicone rubber (S-5) was prepared in the same manner as in Material Example 1 except for replacing the ferric chloride (D-2) with 3 wt. % with respect to the mixture before the addition thereof of heat-resistant silica powder ("R-972", available from Nippon Aerosil K.K.).

The silicone rubber (S-5) was one providing, after curing, a dimethylsilicone rubber exhibiting a storage modulus of $2.01\times10^7$ dyn/cm$^2$ and a loss modulus of $7.88\times10^5$ dyn/cm$^2$.

<Comparative Material 2>

A yet-uncured liquid silicone rubber (S-6) was prepared in the same manner as in Material Example 1 except for replacing the mixture of the polysiloxanes (A-a-1) and (A-b-1) with 100 wt. parts of the polysiloxane (A-a-1).

The silicone rubber (S-6) was one providing, after curing, a dimethylsilicone rubber exhibiting a storage modulus of $5.95\times10^7$ dyn/cm$^2$ and a loss modulus of $2.04\times10^6$ dyn/cm$^2$.

<Comparative Material 3>

A yet-uncured liquid silicone rubber (S-7) was prepared in a similar manner as in Material Example 1 except for replacing the polysiloxanes (A-a-1) and (A-b-1) with 80 wt. parts of organopolysiloxane (A-a-3) in the form of a block copolymer having a viscosity at 25° C. of ca. 5 Pa.s and comprising a network polysiloxane segment and a linear polysiloxane segment, and 30 wt. parts of linear dimethylpolysiloxane (A-b-3) having a vinyl group at both ends and a viscosity at 25° C. of ca. 1000 Pa.s.

The silicone rubber (S-7) was one providing, after curing, a dimethylsilicone rubber exhibiting a storage modulus of $4.0\times10^7$ dyn/cm$^2$ and a loss modulus of $13\times10^5$ dyn/cm$^2$.

<Comparative Material 4>

A yet-uncured liquid silicone rubber (S-8) was prepared in the same manner as the production of the silicone rubber (S-7) for Comparative material 3 except for replacing the polysiloxanes (A-a-3) and (A-b-3) with 60 wt. parts of the polysiloxane (A-a-3) and 40 wt. parts of linear dimethylpolysiloxane (A-b-4) having a vinyl group at both ends and a viscosity at 25° C. of ca. 500 Pa.s.

The silicone rubber (S-8) was one providing, after curing, a dimethylsilicone rubber exhibiting a storage modulus of $3.9\times10^7$ dyn/cm$^2$ and a loss modulus of $11\times10^5$ dyn/cm$^2$.

[Performance Evaluation Experiments]

Hereinbelow, some experiments performed for evaluation of performances of the above-prepared surface layer materials (silicone rubbers) will be described.

<Experiment 1>

The following experiment was performed in order to clarify a relationship between a release oil application amount onto a fixing roller surface and oil stickiness on the resultant OHP transparency sheet.

For the experiment, an image forming apparatus ("Color Laser Copier CLC800", available from Canon K. K.) having a structure as illustrated in FIG. 2 was used for reproduction of a blank white paper original on an A4-size color laser copier transparency sheet ("Canon CT-700", designed for "CLC800") according to a one-side full-color copying mode.

In each run of the experiment, a fixing device having a structure as shown in FIG. 3 including a fixing roller 100 and a pressure roller 102 respectively having a surface layer 114 or 124 comprising one of Example materials and Comparative materials pared above was used.

For each fixing device, the abutting pressure of the oil regulating blade 107 was changed to provide varying oil application amounts at levels of 20, 40 and 60 mg/A4-size respectively.

For each run of the experiment, a sheet of OHP transparency was subjected to image formation and fixation in the above-described manner, and the product copy sheet was placed on a glass plate so that the oil-applied side thereof contacted the glass plate to evaluate the stickiness by peeling. The results are inclusive shown in the following Table 1.

TABLE 1

Stickiness on OHP transparency

| Roller surface materials | Release oil application amount [mg/A4-size] 60 | 40 | 20 |
|---|---|---|---|
| Ex. 1 | B | B | A |
| Ex. 2 | B | B | A |
| Ex. 3 | B | B | A |
| Ex. 4 | B | B | A |
| Comp. | | | |
| Ex. 1 | B | B | A |
| Ex. 2 | B | B | A |
| Ex. 3 | B | B | A |
| Ex. 4 | B | B | A |

A: No stickiness,
B: Stickiness noted

Regardless of the roller surfacing material, some stickiness on the OHP transparency was noted at oil application amount levels of 40 mg/A4-size and 60 mg/A4-size, but no stickiness was recognized at an oil application amount level of 20 mg/A4-size.

<Experiment 2>

The following experiment was performed in order to clarify a relationship between a release oil application amount onto a fixing roller surface and an image quality in a both-side image formation mode.

For the experiment, an identical image forming apparatus as used in Example 1 was used including the roller surface material and the oil application amount levels for each run.

In each run, an original of solid magenta sheet (100% image) was successively reproduced by a two-side full-color copying mode on both sides of 50 sheets of A4-size plain paper (basis weight=81.4 g/m$^2$), thereby examining whether blotch image defects were observed with eyes in the fixed images on the 50-th sheet due to soiling with the oil of the photosensitive drum.

The results are inclusively shown in the following Table 2.

TABLE 2

Oil soiling during both-side image formation

| Roller surface materials | Release oil application amount [mg/A4-size] 60 | 40 | 20 |
|---|---|---|---|
| Ex. 1 | B | B | A |
| Ex. 2 | B | B | A |
| Ex. 3 | B | B | A |
| Ex. 4 | B | B | A |
| Comp. | | | |
| Ex. 1 | B | B | A |
| Ex. 2 | B | B | A |
| Ex. 3 | B | B | A |
| Ex. 4 | B | B | A |

A: No soiling observed
B: Oil soiling observed

Again, regardless of the surface materials, blotch image defects were observed in the fixed images at oil application levels of 40 and 60 mg/A4 but were not observed at a level of 20 mg/A4.

<Experiment 3>

This experiment was performed in order to clarify the effects of the fixing roller surface materials on the release performance of the fixing rollers.

An image forming apparatus identical to the one used in Example 1 was used including the roller surface material for each run.

In each run, an original of magenta halftone (50%) was successively reproduced on a large number of sheets of A4-size plain paper (81.4 g/m$^2$) according to a one-side full-color copying mode while varying oil application amounts at low levels of 20 mg/A4 or less. For evaluation, the fixed toner images were observed with eyes whether offset was noted, and the number of copied sheets at which offset was first confirmed in the fixed image was determined as a measure of release life.

The results are inclusively shown in the following Table 3 together with oil application levels and viscoelasticities of the roller surface material.

TABLE 3

Release performance of fixing rollers

| Roller No. | Roller surface material | Viscoelasticities of surface material: storage molecules E' (dyn/cm$^2$) | loss modulus E" (dyn/cm$^2$) | Applied oil amount (mg/A4) | Release life (×10$^3$ sheets) |
|---|---|---|---|---|---|
| Ex. 1 | Ex. 1 | $1.4 \times 10^7$ | $5.3 \times 10^5$ | 20 | >100 |
| Ex. 2 | Ex. 2 | $0.9 \times 10^7$ | $7.0 \times 10^5$ | 10 | >100 |
| Ex. 3 | Ex. 3 | $0.8 \times 10^7$ | $2.3 \times 10^5$ | 15 | >100 |
| Ex. 4 | Ex. 4 | $0.4 \times 10^7$ | $4.6 \times 10^5$ | 5 | >100 |
| Comp. | | | | | |
| Ex. 1 | Comp. 1 | $2.0 \times 10^7$ | $7.9 \times 10^5$ | 15 | 61 |
| Ex. 2 | Comp. 2 | $6.0 \times 10^7$ | $20 \times 10^5$ | 30 | 36 |
| Ex. 3 | Comp. 3 | $4.0 \times 10^7$ | $13 \times 10^5$ | 20 | 58 |
| Ex. 4 | Comp. 4 | $3.9 \times 10^7$ | $11 \times 10^5$ | 15 | 56 |
| Ex. 5 | Ex. 1 | $1.37 \times 10^7$ | $5.3 \times 10^5$ | <0.5 | 16 |

As shown in Table 3, the fixing rollers (Examples 1–4) surfaced with Example materials exhibited substantially longer release life than the fixing rollers (Comparative Examples 1–4) surfaced with comparative materials at a small oil application level of 20 mg/A4-size or below except for a case (Comparative Example 5) where the oil application amount was below 0.5 mg/A4-size.

<Experiment 4>

This experiment was performed in order to clarify the release performance of a pressure roller surface layer in both-side image formation mode.

An image forming apparatus identical to the one used in Experiment 1 was used while changing the roller surface material as shown in Table 4 below.

In each run, an original of magenta halftone (50%) was successively reproduced in A4-size plain paper (81.4 g/m$^2$) according to a both-side full-color copying. At the time of every 100 sheets in each run, the magenta halftone original was replaced by a blank (white) sheet original to reproduce a white image according to the full-color mode on one surface (second surface) of plain paper sheet having an already-fixed magenta halftone image on the other surface (first surface) contacting the pressure roller at the time of fixation performed while applying the release oil onto the fixing roller surface at a low-release oil application level of 10–20 mg/A4-size. Then, the release performance of the pressure roller surface was evaluated by observing whether the already-fixed magenta halftone image on the back surface (first surface) having contacted the pressure roller after the reproduction and fixation of the white image on the second surface caused image dropout or not on such an every 100th sheet.

The results are inclusively shown in the following Table 4.

TABLE 4

Pressure roller release performance in both-side image formation

| Surface materials | | Applied oil | Release performance-pressure roller Image dropout on the pressure roller side | | | | |
|---|---|---|---|---|---|---|---|
| Fixing roller | Pressure roller | amount (mg/A4) | 100th sheet | 200th sheet | 300th sheet | 400th sheet | 500th sheet |
| Ex. 1 | Ex. 1 | 10 | A | A | A | A | A |
| Ex. 2 | Ex. 2 | 15 | A | A | A | A | A |
| Ex. 3 | Ex. 3 | 20 | A | A | A | A | A |
| Ex. 4 | Ex. 4 | 10 | A | A | A | A | A |
| Ex. 1 | Comp. 1 | 15 | A | A | A | B | C |
| Ex. 1 | Comp. 2 | 10 | A | B | C | — | — |
| Ex. 1 | Comp. 3 | 20 | A | A | A | B | C |
| Ex. 1 | Comp. 4 | 15 | A | A | B | C | — |

A: Not observed at all.
B: Slightly observed.
C: Noticeably observed.
—: Operation interrupted.

As shown in Table 4, the pressure rollers surfaced with Example materials caused no image dropout on the resultant images having contacted the pressure rollers, thus exhibiting excellent release performances.

<Experiment 5>

This experiment was performed in order to evaluate the performances of fixing devices including a fixing roller and a pressure roller surfaced with an Example material.

An image forming apparatus identical to the one used in Experiment 1 was used including roller surface material for each run.

In each run, a full color photographic image of a human picture having a good balance of four colors of C, M, Y and K was continuously reproduced on a large number of sheets of A4-size plain paper (81.4 g/m$^2$) according to a one-side full-color mode at a low oil application level of 10 or 20 mg/A4-size.

The fixed images were observed in order to determine the number of copied sheets at which image defects, such as toner offset, occurred, as a measure of release life of the fixing roller surface material.

The results are shown in the following Table 5.

TABLE 5

Performance evaluation in reproduction of full-color photographic image

| Roller surface material | Applied release oil amount [mg/A4] | Release life [×10$^3$ sheets] |
|---|---|---|
| Ex. 1 | 20 | >100 |
| Ex. 2 | 10 | >100 |
| Ex. 3 | 20 | >100 |
| Ex. 4 | 10 | >100 |

As shown in Table 5 above, the fixing devices including fixing rollers surfaced with Example materials exhibited a good release performance over 10$^5$ sheets at a low release oil application level of 10 or 20 mg/A4-size.

What is claimed is:

1. A heat-pressure fixing device for fixing a toner image, comprising a fixing member, a pressure member, and means for applying dimethylsilicone oil as a release oil, wherein the fixing member is surfaced with dimethylsilicone rubber having a storage modulus E' satisfying $1.0\times10^6$ dyn/cm$^2$<E'<$1.5\times10^7$ dyn/cm$^2$ and a loss modulus E" satisfying $1.0\times10^5$ dyn/cm$^2$<E"<$7.5\times10^5$ dyn/cm$^2$, and the dimethylsilicone oil is applied onto the surface of the fixing member at a rate of 1–20 mg/621-cm$^2$ (A4-size).

2. A fixing device according to claim 1, wherein said dimethylsilicone rubber is an addition-polymerization product of an addition-type liquid silicone rubber comprising:

(A) a polysiloxane mixture comprising (a) 50–70 wt. % of an organopolysiloxane comprising a network polysiloxane segment and having at least two vinyl groups per molecule and (b) 30–50 wt. % of a linear polydimethylsiloxane having a terminal vinyl group at both terminals and a viscosity at 25° C. of at least 10000 Pa.s, (B) an organopolysiloxane having at least two silicon-bonded hydrogen atoms per molecule, (C) a platinum-based catalyst, and (D) ferric chloride containing iron in an amount of 3–300 wt. ppm based on the total amount of (A)+(B)+(C).

3. A fixing device according to claim 2, wherein said organopolysiloxane (a) is a block copolymer having a viscosity at 25° C. of at least 1 Pa.s, and comprising at least one network polysiloxane segment having a vinyl group and a linear polysiloxane segment including at least 100 consecutive divalent siloxane segments.

4. A fixing device according to claim 1, wherein said dimethylsilicone rubber is an addition-polymerization product of an addition-type liquid silicone rubber comprising:

(A) a polysiloxane mixture comprising (a) 50 . 70 wt. % of an organopolysiloxane comprising a network polysiloxane segment and having at least two vinyl groups per molecule and (b) 30–50 wt. % of a linear polydimethylsiloxane having a terminal vinyl group at both terminals and a viscosity at 25° C. of at least 10000 Pa.s, (B) an organopolysiloxane having at least two silicon-bonded hydrogen atoms per molecule, (C) a platinum-based catalyst, (D) ferric chloride containing iron in an amount of 3–300 wt. ppm based on the total amount of (A)+(B)+(C), and (E) dimethylsiloxane oil in an amount of 5–20 wt. parts per 100 wt. parts of total of (A)+(B)+(C)+(D).

5. A fixing device according to claim 4, wherein said organopolysiloxane (a) is a block copolymer having a viscosity at 25° C. of at least 1 Pa.s, and comprising at least one network polysiloxane segment having a vinyl group and a linear polysiloxane segment including at least 100 consecutive divalent siloxane segments.

6. A fixing device according to claim 1, wherein the fixing member and the pressure member are respectively in the form of a roller.

7. A fixing device according to any one of claims 1–6, wherein the toner image is composed of at least three color toners.

8. A heat-pressure fixing device for fixing a toner image, comprising a fixing member, a pressure member, and means for applying dimethylsilicone oil as a release oil, wherein each of the fixing member and the pressure member is surfaced with dimethylsilicone rubber having a storage modulus E' satisfying $1.0\times10^6$ dyn/cm$^2$<E'<$1.5\times10^7$ dyn/cm$^2$ and a loss modulus E" satisfying $1.0\times10^5$ dyn/cm$^2$<E"<$7.5\times10^5$ dyn/cm$^2$, and the dimethylsilicone oil is applied onto the surface of the fixing member at a rate of 1–20 mg/621-cm$^2$ (A4-size).

9. A fixing device according to claim 8, wherein said dimethylsilicone rubber is an addition-polymerization product of an addition-type liquid silicone rubber comprising:

(A) a polysiloxane mixture comprising (a) 50–70 wt. % of an organopolysiloxane comprising a network polysiloxane segment and having at least two vinyl groups per molecule and (b) 30–50 wt. % of a linear polydimethylsiloxane having a terminal vinyl group at both terminals and a viscosity at 25° C. of at least 10000 Pa.s, (B) an organopolysiloxane having at least two silicon-bonded hydrogen atoms per molecule, (C) a platinum-based catalyst, and (D) ferric chloride containing iron in an amount of 3–300 wt. ppm based on the total amount of (A)+(B)+(C).

10. A fixing device according to claim 9, wherein said organopolysiloxane (a) is a block copolymer having a viscosity at 25° C. of at least 1 Pa.s, and comprising at least one network polysiloxane segment having a vinyl group and a linear polysiloxane segment including at least 100 consecutive divalent siloxane segments.

11. A fixing device according to claim 8, wherein said dimethylsilicone rubber is an addition-polymerization product of an addition-type liquid silicone rubber comprising:

(A) a polysiloxane mixture comprising (a) 50–70 wt. % of an organopolysiloxane comprising a network polysiloxane segment and having at least two vinyl groups per molecule and (b) 30–50 wt. % of a linear polydimethylsiloxane having a terminal vinyl group at both terminals and a viscosity at 25° C. of at least 10000 Pa.s, (B) an organopolysiloxane having at least two silicon-bonded hydrogen atoms per molecule, (C) a platinum-based catalyst, (D) ferric chloride containing iron in an amount of 3–300 wt. ppm based on the total amount of (A)+(B)+(C), and (E) dimethylsiloxane oil in an amount of 5–20 wt. parts per 100 wt. parts of total of (A)+(B)+(C)+(D).

12. A fixing device according to claim 11, wherein said organopolysiloxane (a) is a block copolymer having a viscosity at 25° C. of at least 1 Pa.s, and comprising at least one network polysiloxane segment having a vinyl group and a linear polysiloxane segment including at least 100 consecutive divalent siloxane segments.

13. A fixing device according to claim 8, wherein the fixing member and the pressure member are respectively in the form of a roller.

14. A fixing device according to any one of claims 8–13, wherein the toner image is composed of at least three color toners.

15. A silicone rubber roller, surfaced with dimethylsilicone rubber having a storage modulus E' satisfying $1.0\times10^6$ dyn/cm$^2$<E'<$1.5\times10^7$ dyn/cm$^2$ and a loss modulus E" satisfying $1.0\times10^5$ dyn/cm$^2$<E"<$7.5\times10^5$ dyn/cm$^2$.

16. A silicone rubber roller according to claim 15, wherein said dimethylsilicone rubber is an addition-polymerization product of an addition-type liquid silicone rubber comprising:

(A) a polysiloxane mixture comprising (a) 50–70 wt. % of an organopolysiloxane comprising a network polysiloxane segment and having at least two vinyl groups per molecule and (b) 30–50 wt. % of a linear polydimethylsiloxane having a terminal vinyl group at both terminals and a viscosity at 25° C. of at least 10000 Pa.s, (B) an organopolysiloxane having at least two silicon-bonded hydrogen atoms per molecule, (C) a platinum-based catalyst, and (D) ferric chloride containing iron in an amount of 3–300 wt. ppm based on the total amount of (A)+(B)+(C).

17. A silicone rubber roller according to claim 15, wherein said dimethylsilicone rubber is an addition-polymerization product of an addition-type liquid silicone rubber comprising:

(A) a polysiloxane mixture comprising (a) 50–70 wt. % of an organopolysiloxane comprising a network polysiloxane segment and having at least two vinyl groups per molecule and (b) 30–50 wt. % of a linear polydimethylsiloxane having a terminal vinyl group at both terminals and a viscosity at 25° C. of at least 10000 Pa.s, (B) an organopolysiloxane having at least two silicon-bonded hydrogen atoms per molecule, (C) a platinum-based catalyst, (D) ferric chloride containing iron in an amount of 3–300 wt. ppm based on the total amount of (A)+(B)+(C), and (E) dimethylsiloxane oil in an amount of 5–20 wt. parts per 100 wt. parts of total of (A)+(B)+(C)+(D).

* * * * *

UNITED STATES PATENT AND TRADEMARK OFFICE

CERTIFICATE OF CORRECTION

PATENT NO. : 5,966,578

DATED : October 12, 1999

INVENTOR(S): OSAMU SOUTOME, ET AL.

It is certified that error appears in the above-identified patent and that said Letters Patent is hereby corrected as shown below:

COLUMN 10:
Line 48, "abut" should read --about--.
COLUMN 11:
Line 30, "celastic" should be deleted; and
Line 31, "layer" should be deleted.
COLUMN 12:
Line 43, "are" should read --area--.
COLUMN 13:
Line 2, "wit" should read --with--.
COLUMN 18:
Line 38, "(a) 50. 70 wt.%" should read --(a)50-70 wt.%--.

Signed and Sealed this

Fifteenth Day of August, 2000

*Attest:*

Q. TODD DICKINSON

*Attesting Officer*

*Director of Patents and Trademarks*